US008997938B2

(12) United States Patent
Friedli et al.

(10) Patent No.: US 8,997,938 B2
(45) Date of Patent: Apr. 7, 2015

(54) MODERNIZING AN ELEVATOR INSTALLATION

(75) Inventors: Paul Friedli, Remetschwil (CH); Dennys Taiana, Losone (CH)

(73) Assignee: Inventio AG, Hergiswil NW (CH)

( * ) Notice: Subject to any disclaimer, the term of this patent is extended or adjusted under 35 U.S.C. 154(b) by 627 days.

(21) Appl. No.: 13/434,519

(22) Filed: Mar. 29, 2012

(65) Prior Publication Data

US 2012/0267203 A1 Oct. 25, 2012

(30) Foreign Application Priority Data

Mar. 30, 2011 (EP) ..... 11160509

(51) Int. Cl.
*B66B 1/28* (2006.01)
*B66B 1/34* (2006.01)
*B66B 19/00* (2006.01)

(52) U.S. Cl.
CPC *B66B 1/34* (2013.01); *B66B 19/007* (2013.01)

(58) Field of Classification Search
CPC .... B66B 1/3407; B66B 1/3423; B66B 3/002; B66B 5/0087; B66B 19/0007
USPC ..... 187/247, 380–388, 391–396
See application file for complete search history.

(56) References Cited

U.S. PATENT DOCUMENTS 4,844,204 A * 7/1989 Ovaska et al. ..... 187/247
5,352,857 A * 10/1994 Ovaska ..... 187/247
5,389,748 A * 2/1995 Burke et al. ..... 187/247
6,439,349 B1 * 8/2002 Smith ..... 187/382
6,892,861 B2 * 5/2005 Friedli ..... 187/247
6,935,465 B2 * 8/2005 Friedli ..... 187/247
7,918,318 B2 * 4/2011 Friedli et al. ..... 187/247
8,172,043 B2 * 5/2012 Hughes et al. ..... 187/382
8,517,149 B2 * 8/2013 Flynn et al. ..... 187/247
8,640,831 B2 * 2/2014 Talonen ..... 187/391
8,662,255 B2 * 3/2014 Flynn et al. ..... 187/247
2008/0149432 A1 6/2008 Friedli et al.
2010/0270110 A1 * 10/2010 Mattsson et al. ..... 187/387

FOREIGN PATENT DOCUMENTS

WO WO 2010/031753 A1 3/2010

OTHER PUBLICATIONS

European Search Report dated Sep. 21, 2011, issued in priority European Application No. 11160509.

* cited by examiner

*Primary Examiner* — Anthony Salata
(74) *Attorney, Agent, or Firm* — Stroock & Stroock & Lavan LLP

(57) ABSTRACT

A method for modernizing an elevator installation includes installing story terminals for input of a destination story on the stories of the building, which terminals are so coupled with an elevator control device connected with an input device in the elevator cage that, at least in a standard mode, after input of the destination story call detected by means of the story terminal, the cage automatically travels to the selected destination story, and in that case a story selection in the cage by use of the input device is no longer possible. The indicating means for representing selected stories of the input device are so incorporated in the control system that the indicating means, after input of a story call by way of the story terminal, are activated.

13 Claims, 2 Drawing Sheets

MODERNIZING AN ELEVATOR INSTALLATION

CROSS-REFERENCE TO RELATED APPLICATION

This application claims priority to European Patent Application No. 11160509.3, filed Mar. 30, 2011, which is incorporated herein by reference.

FIELD

The disclosure relates to modernizing an elevator installation

BACKGROUND

Elevator installations for conveying persons and goods have been known for a long time and are customary. Since elevator installations are relatively long-term capital-cost items with service lives of 20 years and more it can happen that with time these no longer satisfy changing demands. In certain circumstances modernization of the installation may be required. By the term "modernization" there is to be understood in the following not just exchange of technologically aged components. Modernization can also mean rebuilding or redesigning existing installations and thus adapting these to new needs. Through modernization, elevator installations can, for example, be operated more safely, more efficiently, more comfortably for users and/or more favorably for operators.

In elevator installations of older modes of construction the stories are selected by pressing touch buttons of an input device arranged in an elevator cage. Increasing popularity is enjoyed by elevator installations with story terminals which are arranged on stories and by way of which destination calls can be input from outside the cage, whereby the installations can be operated more efficiently.

SUMMARY

At least some of the disclosed embodiments include a method for modernization of elevator installations. In the modernization a story terminal for input of the destination story is installed on at least one story of the building. This story terminal is so coupled (directly or indirectly) to the control device connected with the input device of the cage side that at least in the standard mode after input of the destination story call detected by means of the story terminal the cage automatically travels to the selected destination story, wherein at the same time a story selection in the cage is no longer possible by use of the input device. With the aforementioned indirect coupling it is possible in the modernization to integrate in a control system, which includes the control device, a further control device. Through the addition of the story terminal to the existing installation and the electronic coupling of the story terminal the at least one elevator can be operated by an advantageous destination call control. Due to the fact that in the standard mode after story selection with use of the story terminal is excluded or blocked by way of the input device at least under certain preconditions, unplanned stops of the cage can be prevented and thus the elevator installation operated more efficiently. The input device at the cage side remains in place and can be further used.

The input device having activatable indicating means for representation of selected stories is further adapted in such a manner in the modernization of the control device that the indicating means after input of the story call by way of the story terminal are activated. The mentioned indicating means can in that case be, for example, letters, numbers, drawings or figures illustrated on a touchscreen surface. Activated indicating means can, for example, be lit up more brightly or in another color. The user thus sees in the cage which story he or she has selected beforehand at the story terminal and to which destination the elevator will now convey him or her.

The already existing input device can comprise a touchscreen surface with input buttons possibly of capacitive design, wherein prior to the modernization they react to button contacts and thus enable input of the desired story by the user. In the modernization the control device can be adapted in such a manner that at least in a standard mode the touchscreen function, which reacts to contact, of the input buttons for story selection is deactivated. Apart from the capacitive system, resistive, inductive or other contact-sensitive systems are also conceivable.

In some embodiments the control device can in the modernization be so set by, for example, adaptation of the control program, that the buttons at least associated with the story selection, or the region of the touchscreen surface associated with the story selection, of the input device serves after the modernization substantially only for information purposes.

The input device can have, apart from buttons for story selection, further special input buttons. These special input buttons can be provided for, for example, issue of an alarm in emergency situations, emergency opening or possibly for ensuring a longer time of opening for disembarking of handicapped users. The system containing the story terminal, the input device and the control device can be adapted in such a manner in the modernization that after the modernization the mentioned special input buttons are operable in an operating mode in which the special input buttons—by contrast to the input buttons for the story selection—remain activatable.

If the input device comprises a card reader and/or a handicapped person's button it can be advantageous if in the modernization the control device is adapted in such a manner that after reading of an authorized card or in the case of button pressure on or button contact with the handicapped person's button the deactivated input buttons are freed for renewed input for an activation. In this manner an efficient and nevertheless flexible mode of operation for the elevator can be ensured after the modernization.

Further embodiments comprise the use of an input device of the cage side, which possibly comprises a touchscreen surface with input buttons, possibly of capacitive design, wherein the input device is distinguished by the fact that it can be used unchanged in an elevator installation before and after modernization. Before modernization, the user has to input the desired story by way of input buttons rather than input means. After the modernization the input device serves with respect to the input means concerning stories only for information purposes. After the story selection, i.e. after input of the destination story call detected by means of the story terminal, a story selection in the cage is no longer possible by users of the input device.

Further embodiments relate to a computer program product for operating and modernization of the afore-described installation.

BRIEF DESCRIPTION OF THE DRAWINGS

Further individual features of the disclosed embodiments are evident from the following description of an exemplifying embodiment and from the drawings, in which.

DETAILED DESCRIPTION

Figure 1:
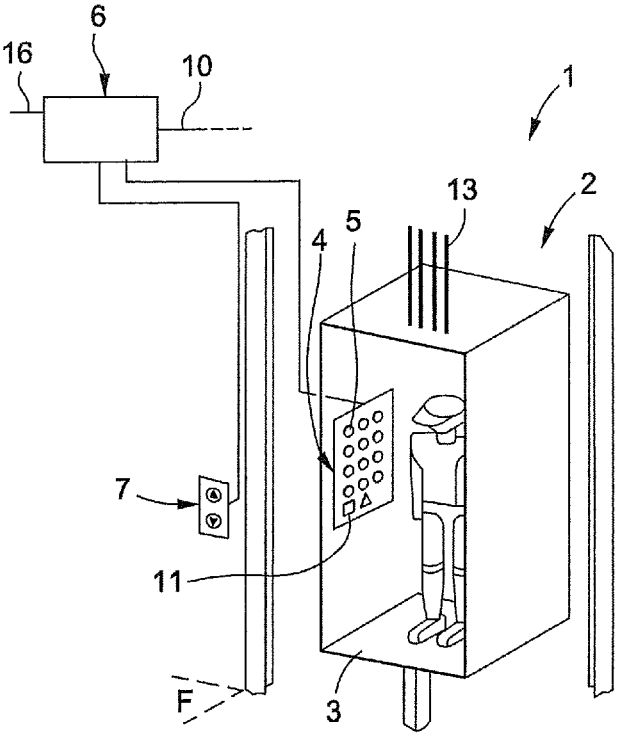
FIG. 1 shows a simplified illustration of an existing installation or an installation to be modernized.

FIG. 1 shows an elevator installation, which is denoted overall by 1, with an elevator 2, which has a cage movable in a vertical shaft. Depending on the size of the building and the building purpose the elevator installation can also comprise several elevators arranged adjacent to one another, which can be designed to be the same as or similar to that in FIG. 1. Also not illustrated are the further stories disposed above and below with respect to the story plane F.

A cage 3 of the elevator installation is, for example, fastened to several support cables 13 and movable upwardly and downwardly by way of known drive means. The following modernization method still to be described in more detail is, however, also suitable for other elevator types. In particular, instead of support cables also other support means such as individual or multiple support belts of different materials and compositions such as synthetic materials, metals or other materials can come into question. The modernization method would also be conceivable for hydraulically operated elevators.

A line by way of which the drive means (not illustrated) are activatable is indicated by 10. The elevator installation according to FIG. 1 contains on each story of the building an input device 7 which is mounted on a vertical wall and disposed near the elevator shaft and by way of which a user can call the cage to his or her story. Input devices of that kind at the story side are also located in the stories lying above and below. An input device, which is denoted by 4, is arranged at an inner side of a cage wall of the elevator cage 3. The input device 4 has input buttons 5 by way of which the user can input his or her destination story. Apart from these destination story input buttons 5 the input device 4 has further buttons 11 for special purposes. These buttons 11 serve for, for example, issue of an alarm, emergency opening or as a so-called handicapped person's button. The story terminal 8 has, for example, a touchscreen surface on which the input buttons 9 and 11 are arranged.

The control device denoted by 6 is electronically connected by way of conductors, which are indicated by lines, with the input device 4 at the cage side, the cage call input device 2 and by way of the conductor 10 with the drive for the elevator 2. The device at the cage side comprises a touchscreen surface, the input buttons 5 and 11 of which are designed as capacitive touch-sensitive buttons. The input device 4 is designed in such a manner that, for example, at the time of or after selection of a story the corresponding button after contact by the user lights up. The control device 6 comprises memory means (not illustrated) on which data and a computer program for operating the elevator installation 1 are stored. The control device 6 has an interface 16 by way of which communication with the control system can be produced and further data can be supplied to the memory means of the control device 6.

Figure 2:
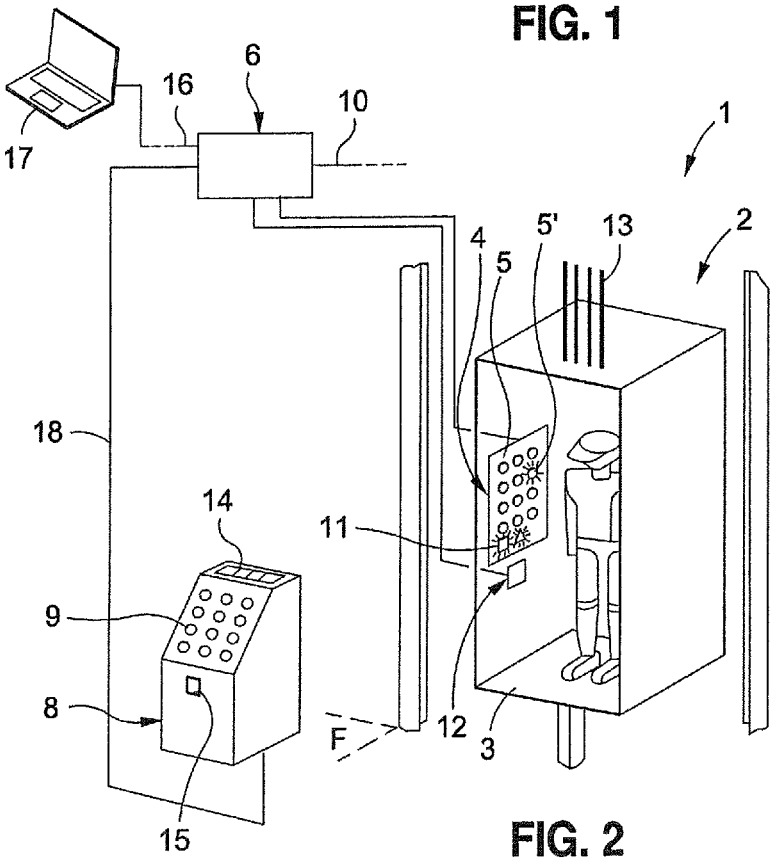
FIG. 2 shows the elevator installation after modernization.

The demands imposed on an elevator installation can change in the course of time. Starting from the existing installation according to FIG. 1 the elevator installation can be modified in such a manner by the disclosed modernization methods that the elevator installation can thereafter be operated more efficiently. In the modernization, story terminals are installed on the stories of the building, which terminals are connected with the control device 6 by way of data lines 18 (FIG. 2). The story terminals 8 can, as evident from the exemplifying embodiment according to FIG. 2, be designed as column-like column bodies protruding relative to the floor of the story plane F. The story terminal 8 has, by way of example, an inclined surface on which input buttons 9 for each story are arranged. Indicating means 14 for allocation of the elevator to the user are arranged on a horizontal surface. Other shapes and modes of construction for story terminals are obviously also conceivable. As evident from FIG. 2, in the course of the modernization the input devices located on the stories near the shaft are removed (see FIG. 1: input device 7). However, further embodiments can leave the installed input device (7; FIG. 1) in place and merely deactivate the corresponding buttons of the mentioned input device by adaptation of control system. Alternative story terminals could comprise touchscreens fastened to building inner walls. For example, at each story a flat story terminal could replace the simple cage call input device or be arranged in place thereof on the wall.

In the modernization, a technician produces a connection with the control system by way of the interface 16 and in that case introduces a new computer program product or an update for the existing computer program product into the system, whereby after the modernization the elevator installation can be operated in the previously described mode and manner. The computer program product or the update thereof is stored in an electronic data processing unit. This data processing unit can be a component of the control device 6. However, it would also be conceivable to arrange the data processing unit at the input device 4 at the cage side.

A technician can now perform the upgrade of the elevator installation and reconfigure the control in simple mode and manner by a laptop 17 or another apparatus. A corresponding data packet for the update or the reconfiguration of the control can be filed on a memory element (for example a memory card). Moreover, it would also be conceivable to design, by means of portable wireless transmitters or by way of a near-field radio connection, for prevention of improper interventions in the control system. The coupling can be effected by way of data cable or also in wire-free manner. The interface can then also be designed in such a manner that a technician can access and intervene on or in the control system from a remote location in that he or she, for example, executes a so-called 'remote' by way of the Ethernet. In this manner, the modernization can be performed very rapidly. Through the reuse of the existing touchscreen of the input device 4 it can be ensured that—with the exception of the story terminal to be installed—no high investment costs in the elevator installation are needed.

After modernization has been carried out, the mode of operation of the elevator installation 1 in the standard mode is as follows: After the user has selected the destination story, which is designed by him or her, on the story terminal 8 with use of the buttons 9 an elevator is allocated to him or her by the display 14 (FIG. 2). In the cage 3 of the elevator 2 allocated to him or her the touchscreen surface of the input device 4 shows the story previously selected by him or her. This can be effected, for example, by lighting up the input button provided with a number for a story. An input button lit up in that manner is indicated in FIG. 2 by 5'. A card reader 12 is disposed below the touchscreen surface of the input device 4. The card reader can also be integrated in the input device 4.

Other locations for the card reader are also conceivable. Thus, the card reader could comprise, for example, a sensor or a receiver arranged behind the same glass pane for the touchscreen surface of the input device 4. The story terminals do not necessarily have to comprise touchscreen surfaces; tactile pushbuttons or other input variants, for example, also come into question. The story selection can additionally or alternatively be effected for input via the buttons 9 also through an identification of the user. For this purpose the story terminal 8 can comprise a card reader 15 or other identification unit. After identification of an authorized user, for example by means of an ID card, the control system recognizes to which destination story the user would like to travel.

In at least some embodiments, the region, which is associated with the story selection, of the touchscreen surface of the input device with the input buttons 5 serves, after the modernization, only for information purposes. The input device 4 receives, triggered by the story selection at the story terminal 8, an activation signal from the control device. Thereafter, the indicating means associated with the selected story are activated for representation of the story. Indicating means activated in that manner can comprise lighting up. Insofar as the remaining indicating means at least in the operating phase permanently light up, it can be advantageous if the activated indicating means lights up more brightly and/or in another color. The indicating means can be designed as components separate from the input buttons. The indicating means can be designed as an integrated component of the input buttons. A button indicating a story in this manner by lighting up is indicated in FIG. 2 by way of example as a button denoted by 5'. In addition, after the modernization, usual specific input buttons can remain activatable. The buttons serving for special purposes such as issue of an alarm, emergency opening or the like are denoted in FIGS. 1 and 2 by 11.

The modernized control system, however, also permits departures from the standard mode for specific cases: Thus, the control system can optionally be adapted in such a manner that after reading of an authorized card and/or in the case of button pressure on or button contact with a handicapped person's button 11 the deactivated input buttons 5 are freed for renewed input for activation.

Figure 3:
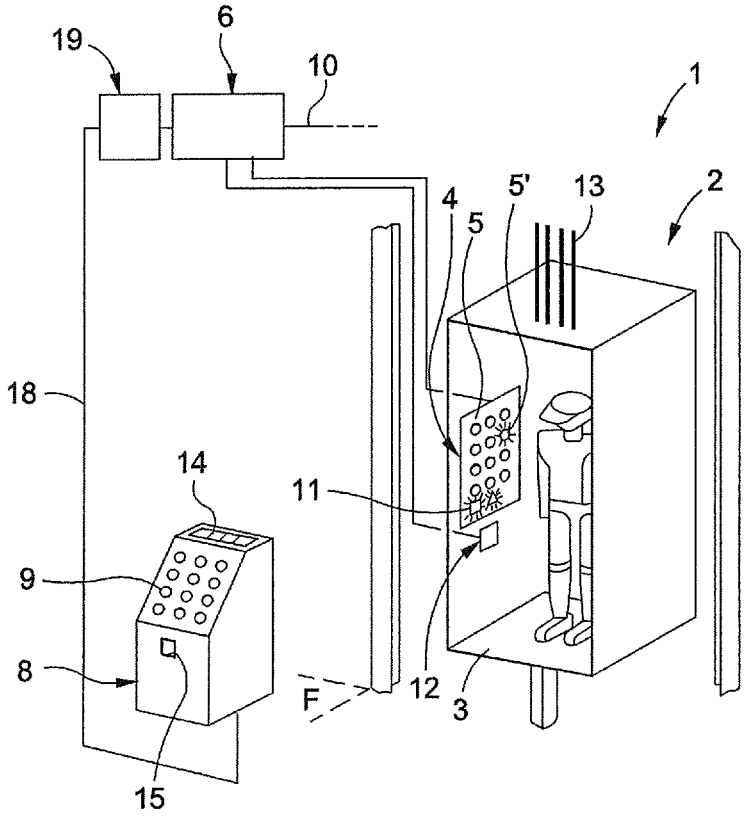
FIG. 3 shows a further variant of the elevator installation after the modernization.

Depending on how the hardware of the original control device was designed, it can be necessary in the modernization to undertake control engineering adaptations of the control system so as to enable the new functionality. In cases of that kind, as evident from FIG. 3, an additional control device 19 or a further control module is integrated in the control system. As far as the newly added control device 19, the elevator installation 1 corresponds with the installation of FIG. 2. In FIG. 3 the control device 19 is, by way of example, constructed as a separate subassembly disposed in operative connection with the first control device 6. The control device 19 can already be pre-configured, whereby the elevator installation is quickly ready for reuse. Moreover, it is also conceivable to configure the control or if required also undertake an update or a reconfiguration of the control software by way of means (not illustrated here) such as, for example, a laptop connected by way of an appropriate interface, by way of a near-field radio connection or by way of an Ethernet remote.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator modernization method, comprising:

installing a story terminal on a story of a building that is served by an elevator installation, the story terminal being for input of a destination story call, the elevator installation comprising a control device and a cage disposed in a shaft, an input device being located in the cage, the input device being coupled to the control device to provide call information to the control device;

deactivating one or more call input buttons on the input device, such that the one or more call input buttons do not provide call information that is used by the control device in scheduling movement of the elevator cage; and configuring the control device to use the one or more input buttons to indicate a destination of the cage according to the destination story call.

2. The elevator modernization method of claim 1, the input device comprising a touchscreen bearing the one or more call input buttons, the deactivating the one or more call input buttons comprising deactivating respective touch-sensitivities of the one or more call buttons.

3. The elevator modernization method of claim 2, the touchscreen being a capacitive touchscreen.

4. The elevator modernization method of claim 1, further comprising coupling a further control device to the control device.

5. The elevator modernization method of claim 4, further comprising performing a software update for the elevator installation through the further control device.

6. The elevator modernization method of claim 1, further comprising performing a software update for the elevator installation through the control device.

7. The elevator modernization method of claim 1, one or more additional buttons of the input device located in the cage being configured to provide input to the control device after the deactivating of the one or more call input buttons.

8. The elevator modernization method of claim 1, further comprising reactivating the one or more call input buttons on the input device, such that the one or more call input buttons provide call information that is used by the control device in scheduling the elevator cage.

9. The elevator modernization method of claim 8, the reactivating being performed in response to a reading of a card by a card reader of the input device.

10. The elevator modernization method of claim 8, the reactivating being performed in response to a pressing of an additional button of the input device.

11. The elevator modernization method of claim 10, the additional button of the input device being a handicapped button.

12. An elevator installation comprising:

an elevator car disposed in a shaft;

a story terminal installed on a story of a building served by the elevator installation;

an input device located inside the elevator car, the input device comprising one or more call input regions; and an elevator control device coupled to the story terminal and to the input device, the elevator control device being programmed to determine a destination story for the elevator car based on input from the story terminal and further programmed to indicate the destination story using at least one of the one or more call input regions.

13. One or more computer-readable storage media having encoded thereon instructions that, when executed by an elevator control device of an elevator installation, cause the elevator control device to perform a method, the method comprising:

receiving a destination input from a story terminal coupled to the elevator control device, the story terminal being located on a story of a building served by the elevator installation;

determining a destination for an elevator car of the elevator installation based on the received destination input; and instructing an input panel in the elevator car to display an indication of the destination for the elevator car using a call input region of the input panel.

* * * * *